US006113776A

United States Patent [19]

Upson

[11] Patent Number: 6,113,776

[45] Date of Patent: Sep. 5, 2000

[54] FCC PROCESS WITH HIGH TEMPERATURE CRACKING ZONE

[75] Inventor: Lawrence L. Upson, Barrington, Ill.

[73] Assignee: UOP LLC, Des Plaines, Ill.

[21] Appl. No.: 09/093,064

[22] Filed: Jun. 8, 1998

[51] Int. Cl.[7] ..... C10G 11/00; C10G 51/02

[52] U.S. Cl. ..... 208/113; 208/67; 208/72; 208/74; 208/75; 208/78

[58] Field of Search ..... 208/67, 72, 74, 208/75, 78, 113

[56] References Cited

U.S. PATENT DOCUMENTS

| | | | |
|---|---|---|---|
| 2,550,290 | 4/1951 | Pelzer et al. | 196/52 |
| 2,883,332 | 4/1959 | Wickham | 208/74 |
| 2,915,457 | 12/1959 | Abbott et al. | 208/74 |
| 3,161,582 | 12/1964 | Wickham | 208/74 |
| 3,607,129 | 9/1971 | Carson | 23/288 S |
| 3,679,576 | 7/1972 | McDonald | 208/74 |
| 3,766,838 | 10/1973 | Knoll et al. | 95/4.5 R |
| 3,888,762 | 6/1975 | Gerhold | 208/120 |
| 4,090,948 | 5/1978 | Schwarzenbek | 208/74 |
| 4,606,810 | 8/1986 | Krambeck et al. | 208/74 |
| 4,624,771 | 11/1986 | Lane et al. | 208/74 |
| 4,717,466 | 1/1988 | Herbst et al. | 208/113 |
| 4,830,728 | 5/1989 | Herbst et al. | 208/78 |
| 4,853,105 | 8/1989 | Herbst et al. | 208/74 |
| 4,871,446 | 10/1989 | Herbst et al. | 208/152 |
| 4,874,503 | 10/1989 | Herbst et al. | 208/67 |
| 4,892,643 | 1/1990 | Herbst et al. | 208/70 |
| 4,990,239 | 2/1991 | Derr, Jr. et al. | 208/68 |
| 5,082,983 | 1/1992 | Breckenridge et al. | 585/475 |
| 5,152,883 | 10/1992 | Melin et al. | 208/61 |
| 5,154,818 | 10/1992 | Harandi et al. | 208/74 |
| 5,310,477 | 5/1994 | Lomas | 208/78 |
| 5,314,610 | 5/1994 | Gartside | 208/80 |
| 5,389,232 | 2/1995 | Adewuyi et al. | 208/120 |
| 5,401,389 | 3/1995 | Mazzone et al. | 208/89 |
| 5,451,313 | 9/1995 | Wegerer et al. | 208/164 |
| 5,582,711 | 12/1996 | Ellis et al. | 208/76 |

FOREIGN PATENT DOCUMENTS 2 216 896 8/1988 United Kingdom .

*Primary Examiner*—Walter D. Griffin

*Attorney, Agent, or Firm*—Thomas K. McBride; John G. Tolomei

[57] ABSTRACT

A high efficiency FCC process obtains the necessary regenerated catalyst temperature for a principally thermal cracking stage by cracking a light feedstock such as naphtha or a middle distillate in a first riser that principally performs thermal cracking and then cracks a heavy FCC feed in a second riser with a blend of catalyst from the principally thermal cracking step and recycle catalyst from the heavy feed to provide the necessary coke content on the catalyst that will produce high regenerated catalyst temperatures. The high temperature of the regenerated catalyst in the first riser provides a convenient means of cracking naphtha under high severity conditions and then using the remaining activity of the contacted catalyst for the principally catalytic reaction of the heavier feed. A separate thermal cracked product may be recovered from an intermediate blending vessel downstream of the first riser. Alternately, the thermal products such as cracked naphtha products may remain with the effluent from the second riser for separation from the heavy cracked products in a downstream separation zone.

15 Claims, 3 Drawing Sheets

FCC PROCESS WITH HIGH TEMPERATURE CRACKING ZONE

FIELD OF THE INVENTION

This invention relates generally to processes for the fluidized catalytic cracking (FCC) of heavy hydrocarbon streams such as vacuum gas oil and reduced crudes. This invention relates more specifically to a method for separately reacting a feed in a principally thermal cracking zone and another feed in a principally catalytic cracking zone.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules associated with the heavy hydrocarbon feed are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium.

The FCC process is carried out by contacting the starting material—whether it be vacuum gas oil, reduced crude, or another source of relatively high boiling hydrocarbons—with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. The cracking reaction deposits coke on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content relative to the catalyst in the stripper, hereinafter referred to as regenerated catalyst, is collected for return to the reaction zone. Oxidizing the coke from the catalyst surface releases a large amount of heat; a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The FCC unit cracks gas oil or heavier feeds into a broad range of products. Cracked vapors from the FCC reactor enter a separation zone, typically in the form of a main column, that provides a gas stream, a gasoline cut, cycle oil and heavy residual components. The gasoline cut includes both light and heavy gasoline components. A major component of the heavy gasoline fraction comprises heavy single ring aromatics.

It has long been desired to process more than one feedstock in an FCC unit. FCC processes have been proposed for cracking multiple feeds in a single riser. U.S. Pat. No. 4,392,643 specifically discloses the cracking of first a gas oil mixture followed by cracking of a naphtha boiling range stream in a single FCC riser. It is also known from U.S. Pat. No. 5,389,232 to use a heavy naphtha boiling range hydrocarbon as a quench in an FCC riser to control the riser temperature and the cracking of a gas oil feed.

Recent advances in FCC process arrangements have led to significant reductions in the amount of the coke laid down on the catalyst in the reaction zone. Improvements to the distribution of feed and the separation of products from catalyst have largely contributed to the reduction in coke production. While reduction in coke is desirable overall, it has the effect of limiting the operating temperature of the regeneration zone and the resulting temperature of the regenerated catalyst. Lower regenerated catalyst temperatures reduce the reaction temperature in the reactor riser. Lower reaction temperatures shift the cracking reaction away from thermal cracking and toward catalytic cracking. To maintain conversion it is often necessary to circulate more catalyst with the feed. Circulating more catalyst can be an imperfect solution to reduced conversion. First, the higher catalyst circulation rate may tend to further reduce coke lay down resulting in a downward temperature spiral for the regenerated catalyst as the temperature of the catalyst decreases with increased circulation and the circulation must continue to increase with decreasing catalyst temperature. In addition, in many existing units the catalyst circulation rate may be limited so that increasing the catalyst to feed ratio may come at the expense of limiting feed throughput.

Relatively lower regenerated catalyst temperature poses special problems for conversion zone arrangements. Circulation of the catalyst through an additional conversion zone will have an inherent cooling effect. Moreover, in the vast majority of cases the additional conversion zone will effect an endothermic reaction. Therefore, the additional conversion zone operates as a catalyst cooler that further removes heat from the process and continues the depression of regenerated catalyst temperatures. The problem becomes further exacerbated where the additional conversion would benefit from higher operating temperatures, such as in the case of thermal cracking, but high temperature catalyst is unavailable.

The available methods of increasing regenerated catalyst temperature are not commercially attractive. Reducing the hydrocarbon conversion and/or the recovery of hydrocarbons from the process will increase regenerator temperature, but at the expense of overall process efficiency. Various promoters and combustion material may be added to the regenerator to promote CO combustion or to combust additional fuel. Both of these alternatives add expense and complexity to the operation of the regenerator.

DISCLOSURE STATEMENT

U.S. Pat. No. 2,883,332 describes the use of two separate bed type reaction zones in an FCC process and the charging of a recycle stock to one of the reaction zones and the recovery of the product streams from both of the reaction zones through a common recovery system.

U.S. Pat. No. 3,161,582 teaches the use of a riser reaction zone that converts a first feed and discharges the converted feed into a second bed type reaction zone that treats additional feed of a more refractory nature. All of the converted feeds are recovered from a common dilute phase collection zone in the reactor.

U.S. Pat. No. 2,550,290 discloses an FCC process that contacts an FCC charge oil in a first reaction vessel, separates the products from the first reaction vessel, and contacts the bottoms stream from the product separation in a separate second reaction vessel.

U.S. Pat. No. 2,915,457 describes the treatment of an FCC feed in a first riser type catalytic cracking vessel; separation of cracked hydrocarbons from the first vessel into a gasoline product, a heavy residual stream and a gas oil stream; hydrotreating of the gas oil stream; cracking of the hydrotreated gas oil in a second reaction vessel; and recycling of gas oil and heavier cracked components in the second reaction vessel.

U.S. Pat. No. 3,607,129 shows an apparatus for cracking a heavy FCC feedstock in a riser conversion zone, discharging the cracked product into an FCC reactor vessel, cracking hydrotreated or unhydrotreated light cycle oil in a fluidized catalyst bed in a lower portion of the reaction vessel and withdrawing the cracked products from the riser and the dense bed through a common conduit.

U.S. Pat. No. 4,624,771, issued to Lane et al. on Nov. 25, 1986, discloses a riser cracking zone that uses fluidizing gas to pre-accelerate the catalyst, a first feed introduction point for injecting the starting material into the flowing catalyst stream, and a second downstream fluid injection point to add a quench medium to the flowing stream of starting material and catalyst.

U.S. Pat. No. 3,776,838 shows the cracking of a naphtha stream in a fluidized catalytic cracking process.

U.S. Pat. No. 5,082,983 teaches the introduction of a light reformate stream into an FCC riser.

U.S. Pat. No. 2,915,457 shows multiple-staged catalytic cracking of primary feed and a recycled, cracked product fraction in a separate catalytic cracking zone using spent catalyst from the primary cracking zone.

U.S. Pat. No. 4,830,728 shows the cracking of a primary FCC feed using one type of catalyst in a primary reaction zone and a cracking of a naphtha feed in a second riser reaction zone using a substantially segregated catalyst to independently recover separate primary and secondary feeds from the reaction zones.

U.S. Pat. No. 4,990,239 discloses an FCC process for improving the production of middle distillate fuels by recycling a hydrotreated and hydrocracked light cycle oil to the primary feed of the FCC reaction zone.

U.S. Pat. No. 5,152,883 shows a separate FCC reaction zone for the cracking of a primary FCC feed, the hydrogenation of a bottoms fraction from the cracked FCC product and the recracking of a further separated fraction from the hydrogenation zone effluent in a separate catalytic cracking zone.

U.S. Pat. No. 5,401,389 discloses a catalyst and method for upgrading light cycle oil to a low sulfur gasoline by hydrodesulfurization and hydrogenation for catalytic cracking of the light cycle oil fraction.

U.S. Pat. No. 5,310,477 discloses a riser reaction zone and a fixed bed reaction zone and a single reactor vessel for the catalytic cracking of a primary FCC feed and a heavy gasoline or light cycle oil feed that may undergo optional hydrotreating. The arrangement also shows the potential for separate recovery of the primary and secondary products in separate fractionation zones.

U.S. Pat. No. 5,582,711 discloses an FCC process that uses separate risers for the contacting of a primary feed and a hydrotreated product fraction recovered from the cracked product of the primary feed. The reactor arrangement delivers both products to a common fractionation column.

British reference UK 2216896 A teaches the charging of an FCC feed to an intermediate riser location and the charging of heavy slurry oil feed to a lower riser location.

BRIEF DESCRIPTION OF THE INVENTION

It is an object of this invention to provide a fluidized catalyst process that operates dual conduit conversion zones and supplies regenerated catalyst at relatively high temperatures without the use of promoters or combustion materials.

It is a more specific object of this invention to operate a fluidized catalyst with a conduit conversion zone for principally thermal cracking and a conduit conversion zone for principally catalytic cracking that together produce catalyst with sufficient coke to provide regenerated catalyst at relatively high temperatures.

It is a further object of this invention to use an extended riser arrangement to provide one conduit section for converting a light feed such as a naphtha boiling range feedstream to olefinic products and to provide another conduit section for converting a traditional gas oil feedstream.

It is a further object of this invention to provide an FCC arrangement for conversion of naphtha in one riser conduit section, for intermediate recovery of a naphtha product, and for reuse of the catalyst that has contacted the naphtha feedstream in the catalytic cracking of a relatively heavier feed.

Accordingly, this invention is an FCC process for cracking multiple feeds. The process cracks one feed in one contacting conduit using a blend of catalyst that includes carbonized catalyst from a different contacting conduit as a portion of a catalyst blend to lay down enough coke on catalyst to provide regenerated catalyst with sufficient temperature to promote thermal cracking in one of the contacting conduits. In this manner, the invention provides a first contacting conduit section that can operate as a principally thermal cracking zone. A second contacting conduit utilizes the lightly to moderately coked catalyst from the first contacting conduit as a portion of its catalyst stream for principally catalytic cracking of another feedstream. The principally thermal cracking section benefits from the use of high temperature catalyst. The principally catalytic cracking section benefits from the use of carbonized catalyst that has had previous contact with feed in the thermal cracking conduit but retains ample activity to raise the available catalyst to oil ratio without increasing catalyst circulation through the regenerator.

The carbonized catalyst that is part of the catalyst mixture entering the second contacting conduit may circulate through the reaction side of the process along a variety of paths. Carbonized catalyst that, since its regeneration, has only had prior contact with the feed in the principally thermal cracking zone is referred to as "contacted catalyst." Carbonized catalyst refers more generally to catalyst that has been coked by a single passage through the principally thermal cracking zone and catalyst that has passed through either or both of the principally thermal cracking zone and the principally catalytic cracking zone. Carbonized catalyst is usually referred to as "spent catalyst". However, the carbonized catalyst retains activity and therefore the term "spent catalyst"—while generally accepted—is misdescriptive. It is the intention of this invention to more fully utilize this remaining activity by returning what is herein termed "carbonized" and "contacted" catalyst back to a reaction zone without any regeneration Carbonized catalyst will eventually undergo stripping after contact with feed in one or more of the contacting zones. Catalyst returning to the contacting conduit from the stripping zone is referred to as recycle catalyst.

The contacted catalyst retains high activity while providing additional catalyst for highly desired passivated contact of the heavy feed at high catalyst to oil ratios. Furthermore, the large catalyst to oil ratio provided by the contacted catalyst and the recycle catalyst provides a moderated temperature that remains stable due to the high volume of catalyst present in the primarily catalytic contacting zone. The recycle of the contacted catalyst from the downstream portion of the upstream contacting zone has the additional benefit of lowering the overall catalyst temperature of the thermally cracked feed and catalyst mixture as it exits the upstream contacting zone. The mixing of the contacted catalyst with the recycle catalyst provides a quenching effect on the reaction of the lighter feed component as it exits from relatively higher temperature operating conditions of the upstream contacting conduit.

The contacting conduit that contains the principally thermal cracking reaction, hereinafter referred to as the thermal conduit, passes the catalyst that it discharges into a blending vessel. The blending vessel may directly receive catalyst discharged from the thermal conduit or may receive a mixture of contacted and recycle catalyst from both the thermal conduit and the catalytic conduit, i.e. the contacting conduit that contains the principally catalytic reaction. In either case the blending vessel provides thorough mixing of the contacted catalyst stream from the thermal conduit and recycle catalyst that passes from the outlet of the catalytic conduit. Locating the blending vessel at the downstream end of the thermal conduit will position the blending vessel to receive a direct discharge of catalyst from the thermal conduit. The catalytic conduit may be located immediately upstream of the blending vessel so that the blending vessel separates an upstream thermal conduit and a downstream catalytic conduit. The blending vessel may be arranged to provide independent withdrawal of the cracked products from the thermal conduit. Such an arrangement at least partially segregates vapors from the thermal conduit from the entering feed of the catalytic conduit. Vapors from the thermal conduit that pass into the catalytic conduit may serve as a lift medium for carrying the blended mixture of catalyst through the catalytic conduit.

Whether arranged for separate recovery of thermally cracked and catalytically cracked streams or combined recovery of catalytic and thermally cracked streams the effluent from both conduits will pass through a catalyst separation zone. The catalyst separation zone may comprise any type of catalyst separation such as ballistic or centrifugal separation. The separation will preferably offer a high degree of containment to control residence time and prevent overcracking.

After catalyst separation the fluid from the contacting conduits will pass to a fluid separation zone. The fluid separation section may have separate vessels for separating independently recovered thermally cracked lighter product and an independently recovered catalytically cracked product. Alternately, the separation zone may recover a full range of products from a combined fluid that contains both the effluent of the thermal and downstream catalytic conduits. The separation zone may also provide all or a portion of the feed to the thermal conduits as well as recycle materials for return to the catalytic conduit.

The upstream section of the contacting conduit may crack a variety of different feeds. In most cases the feed to the thermal conduit will have a lower average boiling point than feed to the catalytic conduit. The catalytic conduit ordinarily receives a traditional gas oil feed. Feeds for the thermal conduit will usually comprise light cycle oils and various middle distillate boiling range cuts having a boiling range of from 400 to 700° F. or naphthas boiling in a range of from 80 to 450° F. Naphthas are usually preferred feeds and this invention may produce valuable light products from a variety of feeds to the thermal conduit including a mid-boiling range naphtha (250° F.–360° F.), a high boiling range naphtha (350° F.–430° F.), and a full boiling range naphtha 100° F.–430° F.

The conditions within the thermal conduit will typically provide high catalyst to oil ratios that maximize the temperature available from the regeneration zone for the principally thermal cracking of the feed. Regenerated catalyst will typically enter the thermal conduit in a sufficient amount to produce a catalyst to oil ratio in a range of from 12/1 to 150/1 and preferably in a range of from 20/1 to 50/1. Regenerated catalyst entering the upstream portion of the contacting conduit will usually have a temperature of at least 1330° F. and, once blended with the lower boiling range feed, will produce an average temperature of from 1225 to 1350° F. in the high severity contacting conduit. Contact between the feed and catalyst in the upstream contacting conduit will usually be in a range of from 0.5 to 5 seconds and, preferably, will be in a range of from 2 to 3 seconds.

Repeated contact and blending of the contacting catalyst with recycle catalyst will ordinarily increase the average coke content of the spent catalyst that passes to the regenerator. After recycle and return, spent catalyst entering the regenerator will have from 0.2 to 0.4 wt % more coke on catalyst than is currently obtained from a modern FCC operation processing a feedstock with average coking tendencies. Preferably, the spent catalyst that passes from the reaction of the process to the regenerator will have a coke content of at least 0.8 wt % and, more preferably, will have a coke content of at least 0.9 wt %.

Accordingly, in one embodiment this invention is a fluidized cracking process for the principally thermal cracking of a secondary feed and for the principally catalytic cracking of a primary feed in an arrangement of separate reaction conduits. The secondary feed is typically a light feedstock, preferably a naphtha boiling range, and the primary feed is typically a relatively heavier feedstock. The process comprises passing the secondary feed and regenerated catalyst particles to an upstream portion of a thermal contacting conduit and transporting the regenerated catalyst and secondary feedstock through the thermal contacting conduit to convert the feed to a thermal fluid while producing a first quantity of contacted catalyst particles by the deposition of coke on the regenerated catalyst particles. The thermal contacting conduit discharges the contacted catalyst particles and the thermal fluid from a discharge end. The contacted catalyst particles pass to a blending vessel for blending with a carbonized catalyst which produces a blended catalyst stream. The blended catalyst stream passes from the blending vessel into a catalytic contacting conduit that contacts the blended catalyst mixture in the catalytic contacting conduit with the primary feed to produce a mixture of catalyst and catalytic fluid. A primary catalyst separation zone separates catalyst from the mixture of catalyst and catalytic fluid for the recovery of a primary effluent stream from the primary catalyst separation zone. The process recovers spent catalyst for regeneration in a regeneration zone and the process passes the primary effluent—and optionally a separately recovered portion of the thermal fluid—to a fluid separation zone to recover an olefin product stream comprising ethylene and/or propylene and a primary product stream.

In a more limited embodiment, this invention is a process for the fluidized catalytic cracking (FCC) of a light feedstock, usually naphtha, and a relatively heavier feedstock in a series flow conduit arrangement. The process passes the light feedstock and regenerated catalyst particles to an upstream portion of a secondary contacting conduit and transports the regenerated catalyst and light feedstock through the secondary contacting conduit to convert the light feedstock to a principally thermal cracked fluid. Deposition of coke on the regenerated catalyst particles produces contacted catalyst particles. The contacted catalyst particles and the principally thermal cracked fluid are discharged from a discharge end of the secondary contacting conduit into a blending vessel and blended with carbonized catalyst to produce a blended catalyst stream. The blended catalyst stream passes from the blending vessel into a primary contacting conduit that contacts the blended catalyst mixture with a heavy feed having a higher average boiling point than the light feed to produce a mixture of carbonized catalyst and a principally catalytically cracked effluent. Separating catalyst from the mixture in a primary catalyst separation zone provides recovery of a primary effluent stream from the primary catalyst separation zone. The primary product—and optionally a separately recovered portion of the principally thermally cracked fluid—passes to a fluid separation zone for recovery of a light product stream comprising propylene and ethylene and a heavy product stream. In a more narrow form of this embodiment, the fluid separation zone includes at least two fractionation sections and the principally thermally cracked fluid and the primary effluent pass to separate fractionation sections. Where the lighter feed comprises naphtha, cracking of the lighter stream produces propylene and ethylene in a combined yield of 15–25 wt % of the naphtha feed or 10–25 wt % of the principally thermally cracked fluid.

In another aspect of this invention, a naphtha feedstock is the first feed to pass through a series flow riser arrangement. The naphtha stream and regenerated catalyst particles pass to a thermal cracking riser and travel up the lower riser portion to convert the naphtha feedstock to a cracked naphtha effluent. A quantity of contacted catalyst particles and the cracked naphtha effluent enter a blending vessel that blends a quantity of carbonized catalyst with the quantity of contacted catalyst to produce the blended catalyst stream. The blended catalyst stream passes from the blending vessel into a catalytic cracking riser where the blended catalyst mixture contacts a heavy feed having an average boiling point in a range of from 600 to 1150° F. to produce carbonized catalyst and a heavy cracked effluent. Separation of catalyst from the mixture in the primary catalyst separation zone provides a primary effluent stream that passes to a fluid separation zone.

In another embodiment, this invention is an apparatus for the fluidized cracking of a light feedstock and a heavy feedstock. The apparatus arranges a first contacting conduit section defining a discharge outlet at its downstream end with a first feed conduit for delivering a first feed to the first contacting conduit section. An intermediate portion of the conduit serves as a blending section that directly communicates with the discharge outlet of the first contacting conduit and connects to a catalyst inlet at an upstream end of a second contacting conduit section to provide direct communication with the blending section. A second feed conduit charges a second feedstream to the blending section or the second contacting conduit section. A primary catalyst separator receives a mixture of catalyst and vapors from the discharge end of the second contacting conduit section. At least one fluid separator separates cracked vapors from the second contacting conduit section into a light product stream and a heavy product stream. In addition, an intermediate recovery line may communicate with the blending section to recover a separate light product such as a cracked naphtha product. The first and second contacting conduit sections will usually comprise risers for the upward transport of catalyst and fluids. Ordinarily the blending section has a larger diameter than the first and second contacting conduit sections.

Other objects, embodiments and details of this invention are set forth in the following detailed description of the invention.

DETAILED DESCRIPTION OF THE INVENTION

This invention relates generally to the reactor side of the FCC process. This invention will be useful for most FCC processes that are used to crack light feedstocks and traditional or heavier FCC feedstocks. The process of this invention can be used to modify the operation and arrangement of existing FCC units or in the design of newly constructed FCC units.

This invention can employ a wide range of commonly used FCC catalysts. These catalyst compositions include high activity crystalline alumina silicate or zeolite-containing catalysts. Zeolite catalysts are preferred because of their higher intrinsic activity and their higher resistance to the deactivating effects of high temperature exposure to steam and exposure to the metals contained in most feedstocks. Zeolites are usually dispersed in a porous inorganic carrier material such as silica, alumina, and silica-alumina. These catalyst compositions may have a zeolite content of 30% or more. Particularly preferred zeolites include high silica to alumina compositions such as Ultra Stable Y (US-Y), LZ-210 and blends of these zeolites with ZSM-5 type zeolites. As disclosed in U.S. Pat. No. 5,080,778, the zeolite or silicon enhanced alumina catalysts compositions may include intercalated clays, also generally known as pillared clays.

The relatively heavier feeds suitable for processing by this invention include conventional FCC feedstocks or higher boiling hydrocarbon feeds. The most common of the conventional feedstocks is a vacuum gas oil which is typically a hydrocarbon material prepared by vacuum fractionation of atmospheric residue and which has a broad boiling range of from 600–1150° F. and, more typically, which has a narrower boiling point range of from 650–1025° F. Such fractions are generally low in coke precursors and heavy metals which can deactivate the catalyst.

This invention uses the same general elements of many FCC units. A reactor riser provides the reaction zones. A reactor vessel with a catalyst separation device removes catalyst particles from the gaseous product vapors. A stripping zone removes additional adsorbed hydrocarbons from the catalyst. Spent catalyst from the stripping zone is regenerated in a regeneration zone having one or more stages of regeneration. Regenerated catalyst from the regeneration zone re-enters the reactor riser to continue the process. A number of different arrangements can be used for the elements of the reactor and regenerator sections. The description herein of specific reactor and regenerator components is not meant to limit this invention to those details except as specifically set forth in the claims.

Figure 1:
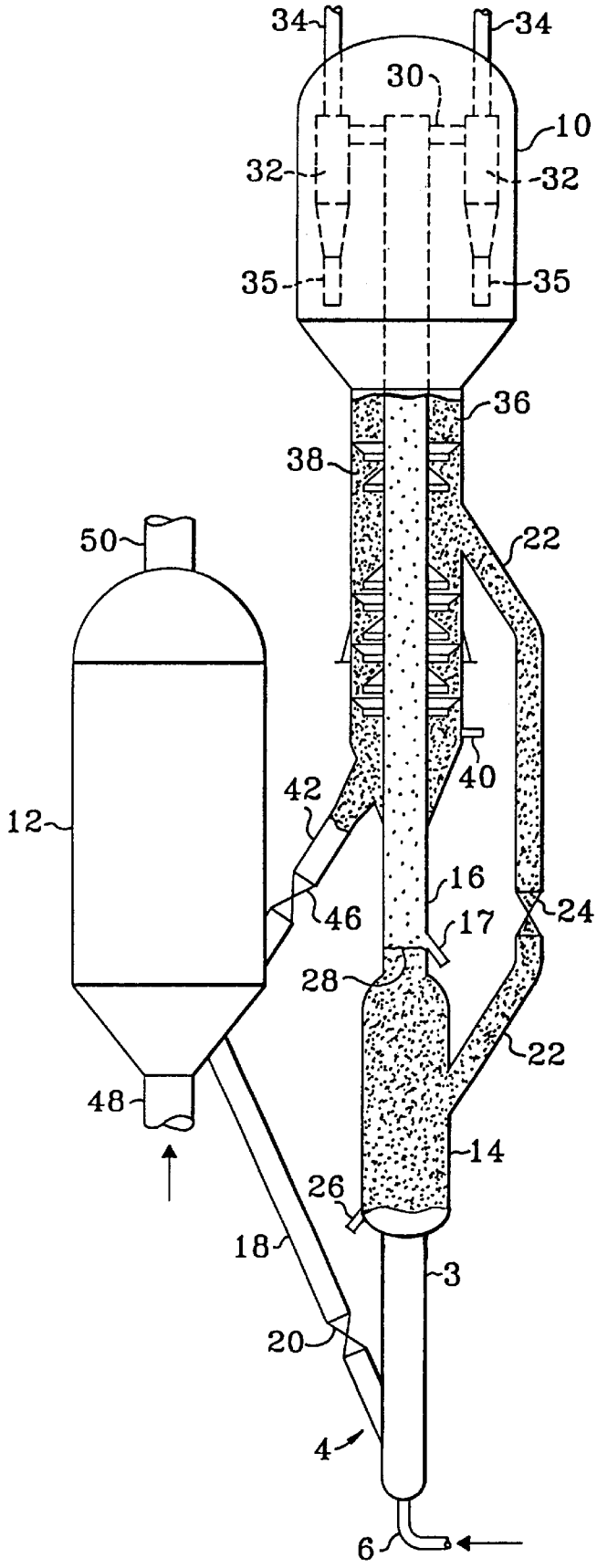
FIG. 1 is a schematic sectional elevation showing an FCC unit arranged for the process of this invention.

This invention is more fully explained in the context of FIG. 1. FIG. 1 shows a typical schematic arrangement of an FCC unit arranged in accordance with this invention. The FCC arrangement shown in FIG. 1 consists of a reactor 10, a regenerator 12, a blending vessel 14, a first elongate riser reaction zone 3 and a second elongate riser reaction zone 16 that each provide a conversion zone for the pneumatic conveyance of catalyst.

Looking more specifically at the operation of the arrangement of FIG. 1, a regenerator conduit 18 passes regenerated catalyst from regenerator 12 into a wye section 4 at a rate regulated by control valve 20. Secondary feed, typically a light feed, is injected into the bottom of Y-section 4 through a nozzle 6 and flows upwardly through a riser section 3 that operates as a thermal contacting conduit. Riser section 3 usually operates with a catalyst to oil ratio in a range of from 12/1 to 150/1. The secondary feed typically has a residence time of from 0.5 to 5.0 seconds in the thermal contacting conduit. The mixture of light feed from nozzle 6 and regenerated catalyst flows out of an outlet of riser section 3 and into blending vessel 14.

A recycle conduit 22 passes catalyst from reactor 10 at a rate regulated by a control valve 24 into blending vessel 14. The light feed provides fluidizing gas for all of the catalyst entering blending vessel 14 from riser section 3 and recycle conduit 22. Additional fluidizing gas may pass into blending vessel 14 by a conduit 26. The fluidizing gas maintains the catalyst in a fluidized state to mix the recycle catalyst from conduit 22 with contacted catalyst from riser section 3. Blending vessel 14 will normally have a larger diameter than either riser section 3 or riser section 16, but not greater than the upper stripper vessel 38. To further promote mixing, conduit 22 may be arranged so that its end has a tangential orientation to the blending vessel that gives the entering catalyst a circumferential component of velocity.

Blending the regenerated catalyst after light feed contact with the recycle catalyst from the stripper 38 increases the relative amount of catalyst that contacts the feed. The amount of blended catalyst that contacts the feed will vary depending on the temperature of the regenerated catalyst and the ratio of recycle and contacted catalyst to regenerated catalyst that comprises the catalyst blend. Generally, the ratio of blended catalyst to the heavy feed will be in a ratio of from 5 to 50. The term "blended catalyst" refers to the total amount of solids that contact the feed and includes both the regenerated catalyst from the regenerator and the recycle catalyst from the reactor side of the process. Preferably, the blended catalyst to feed will be in a ratio of from 10 to 20 and, more preferably, will be in a ratio of from 10 to 15.

This higher ratio of catalyst to heavy feed promotes rapid vaporization of the heavy feed and increases the catalyst surface area in contact with the feed to make vaporization more uniform. The greater quantity of catalyst reduces the added heat per pound of catalyst for raising the temperature of the entering feed so that a suitable reaction temperature is achieved with less temperature differential between the feed and the catalyst. Reduction of the temperature differential between the catalyst and feed prevents localized overheating of the feed and replaces violent mixing with the less severe contacting offered by the elevated volume of catalyst.

Contacted regenerated catalyst will have a substantially higher temperature than the recycle catalyst. Regenerated catalyst from the regenerated conduit 18 will usually have a temperature in a range from 1100 to 1400° F. and, more typically, in a range of from 1200 to 1400° F. Contact with the lighter feed will usually reduce the regenerated catalyst anywhere from 20 to 100° F. Once the blended catalyst mixture contacts the heavier feed, as subsequently described, the blended catalyst mixture accumulates additional coke on the catalyst particles and undergoes a further lowering of its temperature. Upon its return to the blending vessel, the temperature of the recycle catalyst will usually be in a range of from 900 to 1150° F. The relative proportions of the recycle and contacted regenerated catalyst will determine the temperature of the blended catalyst mixture that enters the riser section 16. The blended catalyst mixture will usually range from about 1000 to 1400° F. and, more typically, will range from 1050 to 1250° F. Supplying the heat of reaction for the cracking of the hydrocarbon feed requires a substantial amount of contacted catalyst to enter the blending vessel. Therefore, the blended temperature of the blended catalyst mixture will usually be substantially above the recycle catalyst temperature. Ordinarily the ratio of recycle catalyst to contacted catalyst entering the blending zone will be in a broad range of from 0.1 to 5 and, more typically, will be in a range of from 0.5 to 2.5.

The recycle and contacted catalyst should spend sufficient time in the blending vessel to achieve substantially thermal equilibrium. In a dense phase backmix type zone, residence time of individual particles will vary. However, on average, catalyst particles will have a residence time of at least 2 seconds in the blending vessel. Preferably, the average residence time of the catalyst particles in the blending vessel is in a range of from 20 to 60 seconds. Maintaining dense phase conditions in the blending vessel greatly increases heat transfer between the catalyst particles. The dense phase conditions are characterized by a dense catalyst bed which is defined as having a density of at least 10 lbs/ft$^3$ and, more typically, as having a density of from 20 to 50 lbs/ft$^3$. In order to maintain turbulent conditions within the blending vessel, additional fluidizing medium enters the vessel. The fluidizing gas may be a diluent stream of inert material that enters the bottom of the blending vessel through nozzle 26. Inert materials are preferred for fluidization purposes. Fluidization gas passes through the blending zone at a typical superficial velocity of from 0.2 to 3 ft/sec. The preferred turbulent mixing within the dense catalyst bed fully blends the contacted and recycle catalyst. In this manner, blending vessel 14 supplies a blended catalyst mixture to the bottom of riser 16.

The amount of coke on the recycle catalyst returning to the blending vessel will vary depending on the total residence time of specific catalyst particles within the process loop that passes from the blending vessel to the reactor and back to the blending vessel. Since the separation of catalyst particles out of the riser is random, some catalyst particles may have a long residence time within the reactor vessel before entering the regeneration zone. Nevertheless, the spent catalyst entering the regeneration zone as well as the recycle catalyst from stripper 38 will typically have an average coke concentration of between 0.7 to 1.25 wt %.

The relatively heavier feed may be introduced into blending vessel 14 or into the riser section 16. However, riser 16 usually provides the conversion zone for cracking of relatively heavier feed hydrocarbons. Riser 16 is one type of conversion zone that can be used in conjunction with the blending zone of this invention. Higher relative catalyst flux usually results in riser section 16 having a relatively larger diameter than riser section 3. The heavy feed typically enters riser section 16 through a nozzle 17 somewhere between inlet 28 and a location substantially upstream from an outlet 30. Dense phase conditions may be maintained in the lower portion of the riser conduit below the entry point of the feed. The riser above the point of feed injection typically operates with dilute phase catalyst conditions wherein the density is usually less than 20 lbs/ft$^3$ and, more typically, is less than 10 lbs/ft$^3$. The drawing shows this invention being used with a riser arrangement having a short section of riser between inlet 28 and nozzle 17. If desired, the length of this riser section may be extended and appropriate nozzles added to provide a lift gas zone. A lift gas zone is not a necessity to enjoy the benefits of this invention. Before contacting the catalyst, the feed will ordinarily have a temperature in a range of from 300 to 600° F. Volumetric expansion resulting from the rapid vaporization of the feed as it enters the riser further decreases the density of the catalyst within the riser to typically less than 10 lbs/ft$^3$.

The reactor riser used in this invention discharges the catalyst and gaseous components into a device that performs an initial separation between the catalyst and gaseous components in the riser. The term "gaseous components" includes lift gas, product gases and vapors, and unconverted feed components. Preferably, the end of the riser will terminate with one or more upwardly directed openings that discharge the catalyst and gaseous mixture in an upward direction into a dilute phase section of a disengaging vessel. The open end of the riser can be of an ordinary vented riser design as described in the prior art patents of this application or of any other configuration that provides a substantial separation of catalyst from gaseous material in the dilute phase section of the reactor vessel. The flow regime within the riser will influence the separation at the end of the riser. Typically, the catalyst circulation rate through the upper riser and the input of feed and any lift gas that enters the riser will produce a flowing density of between 3 lbs/ft$^3$ to 20 lbs/ft$^3$ and an average velocity of about 10 ft/sec to 100 ft/sec for the catalyst and gaseous mixture. The length of the riser will usually be set to provide a residence time of between 0.5 to 10 seconds at these average flow velocity conditions. The average temperature of the catalyst and feed mixture in the upper riser will vary from 875–1050° F. Additional amounts of feed may be added downstream of the initial feed point.

The blended catalyst mixture and reacted feed vapors are then discharged from the end of riser 16 through an outlet 30 and separated into a product vapor stream and a collection of catalyst particles covered with substantial quantities of coke and generally referred to as spent catalyst. A separator, depicted by FIG. 1 as cyclones 32, removes catalyst particles from the product vapor stream to reduce particle concentrations to very low levels. Cyclone separators are not a necessary part of this invention. This invention can use any arrangement of separators to remove spent catalyst from the product stream. In particular, a swirl arm arrangement provided at the end of riser 16 can further enhance initial catalyst and cracked hydrocarbon separation by imparting a tangential velocity to the exiting catalyst and converted feed mixture. Such swirl arm arrangements are more fully described in U.S. Pat. No. 4,397,738; the contents of which are hereby incorporated by reference. Product vapors comprising cracked hydrocarbons and some catalyst exit the top of reactor vessel 10 through conduits 34. Catalyst separated by cyclones 32 return to the reactor vessel through dip leg conduits 35 into a dense bed 36.

Catalyst drops from dense bed 36 through the stripping section 38 that removes adsorbed hydrocarbons from the surface of the catalyst by countercurrent contact with steam. Steam enters the stripping zone 38 through a line 40. Spent catalyst, stripped of hydrocarbon vapors, leaves the bottom of stripper section 38 through a spent catalyst conduit 42 at a rate regulated by a control valve 46.

Recycle catalyst for transfer to the blending vessel may be withdrawn from the reaction zone or reactor vessel or even reactor riser after the blended catalyst mixture has undergone a sufficient reduction in temperature. Recycle catalyst is most typically withdrawn downstream of the reactor riser and, more typically, is withdrawn from the stripping zone. FIG. 1 depicts the withdrawal of recycle catalyst from an upper portion of the stripping zone 38. The recycle catalyst conduit transfers one portion of the spent catalyst exiting riser 16 back to the blending vessel as recycle catalyst. Another portion of the spent catalyst is transported to the regeneration zone for the removal of coke.

On the regeneration side of the process, spent catalyst transferred to the regeneration vessel 12 via conduit 42 at a rate regulated by a control valve 46 undergoes the typical combustion of coke from the surface of the catalyst particles by contact with an oxygen-containing gas. The oxygen-containing gas enters the bottom of the regenerator via an inlet 48 and passes through a dense fluidizing bed of catalyst (not shown). Flue gas containing CO and/or $CO_2$ passes upwardly from the dense bed into a dilute phase of regeneration vessel 12. A separator, such as the cyclones previously described for the reactor vessel or other means, removes entrained catalyst particles from the rising flue gas before the flue gas exits the vessel through an outlet 50. Combustion of coke from the catalyst particles raises the temperatures of the catalyst to those previously described for catalyst withdrawn by regenerator standpipe 18.

Product vapors are transferred to a separation zone for the removal of light gases and heavy hydrocarbons from the products. Product vapors typically enter a main column (not shown) that contains a series of trays for separating heavy components such as slurry oil and heavy cycle oil from the product vapor stream. Lower molecular weight hydrocarbons are recovered from upper zones of the main column and transferred to additional separation facilities or gas concentration facilities. The recovery of lighter products may be facilitated by a separation zone that has independent separation vessels, one receiving a primary effluent from the uppermost end of the riser and the other receiving a cracked light product from the blending vessel.

Figure 2:
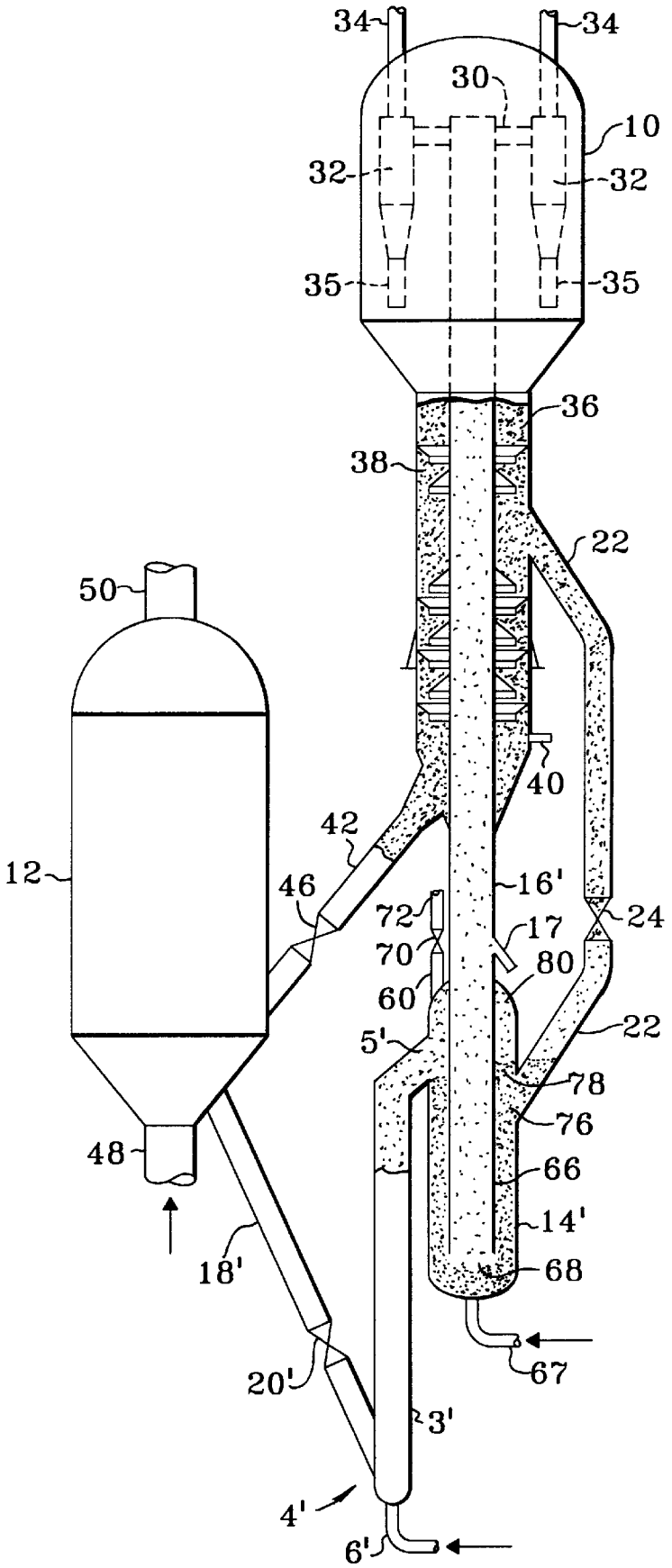
FIG. 2 is a modified sectional elevation of an FCC unit arranged for the process of this invention.

FIG. 2 shows another arrangement for an FCC unit wherein the blending vessel has an outlet nozzle 60 for separate recovery of a relatively light cracked product. This arrangement shows a modified blending vessel 14' at the lower part of a riser section 16'. Looking more specifically at the operation of vessel 14' and a riser section 16', a regenerator conduit 18' passes regenerated catalyst from regenerator 12 into a wye section 4' at a rate regulated by control valve 20'. Light feed is injected into the bottom of Y-section 4' through a nozzle 6' and flows upwardly through a riser section 3'. The mixture of light feed from nozzle 6' and the regenerated catalyst flow out of an outlet 5' of riser section 3' and into blending vessel 14' which passes a mixture of blended catalyst and cracked hydrocarbons to the reactor vessel 10 via a riser 16'. Unless stated otherwise reactor vessel 10, regenerator vessel 12' and the other portions of the FCC apparatus of FIG. 2 are arranged in the same manner as the unit depicted in FIG. 1.

Blending vessel 14' contains a segregation conduit 66 having an inlet 68. Fluidizing gas or feed enters the bottom of blending vessel 14' through a nozzle 67. Additional fluidizing gas may again enter blending vessel 14' at location above or below inlet 68 through one or more additional nozzles (not shown). Outlet nozzle 60 delivers recovered product or other vented gas to a line 72 at a rate regulated by a control valve 70. Aside from lighter product, gas vented from line 72 may consist of any gaseous material that enters the blending vessel from an inlet conduit or with the contacted or recycle catalyst. The amount of fluidizing gas entering blending vessel 14' is again in an amount that will produce a superficial gas velocity in a range of from 1 to 3 ft/sec. However, segregation conduit 66 occludes the top of blending vessel 14' and establishes an annular bed 76 of dense phase catalyst. By regulating the venting of gas from the blending vessel through conduit 72, a bed level 78 is maintained above inlet 68 and preferably below outlet 5'. Bed level 78 provides an interface between a dilute phase 80 and the dense phase bed 76. The dilute phase 80 allows the collection of gas from dense bed 76 so that fluidizing gas or other vaporous materials may pass through dense bed 76 without exiting through riser 16'. Pressure in dilute phase 80 is controlled by regulating the addition of fluidizing gas into blending vessel 14' and the discharge of gas from line 72. Therefore the pressure in the blending vessel 14' will determine the level of the bed 78. The addition of spent catalyst to blending vessel 14' is usually controlled in response to the temperature of the blending vessel 14' by adjusting the position of valve 24.

Blending vessel 14' can provide a number of functions in addition to catalyst blending. For example, the blending zone can be used as an added stage of stripping and provides a particularly beneficial use of the blending zone. The blending of regenerated catalyst typically elevates the temperature of the blended catalyst so that a stripper-blending zone provides hot stripping. Aside from product recovery, the blending zone can strip inert gases from the catalyst. These gases are entrained with the catalyst that comes from the regeneration step.

Line 72 can pass gas out of the top of mixing vessel 14 to a variety of locations. Depending on its composition, the gas may be passed back into the reactor for recovery of additional product vapors, processed separately to recover a secondary product stream or returned to the regeneration zone and combined with the flue gas stream exiting the regenerator. In the preferred arrangement of this invention it will be passed to the product separation zone for recovery of a relatively lighter product stream.

Figure 3:
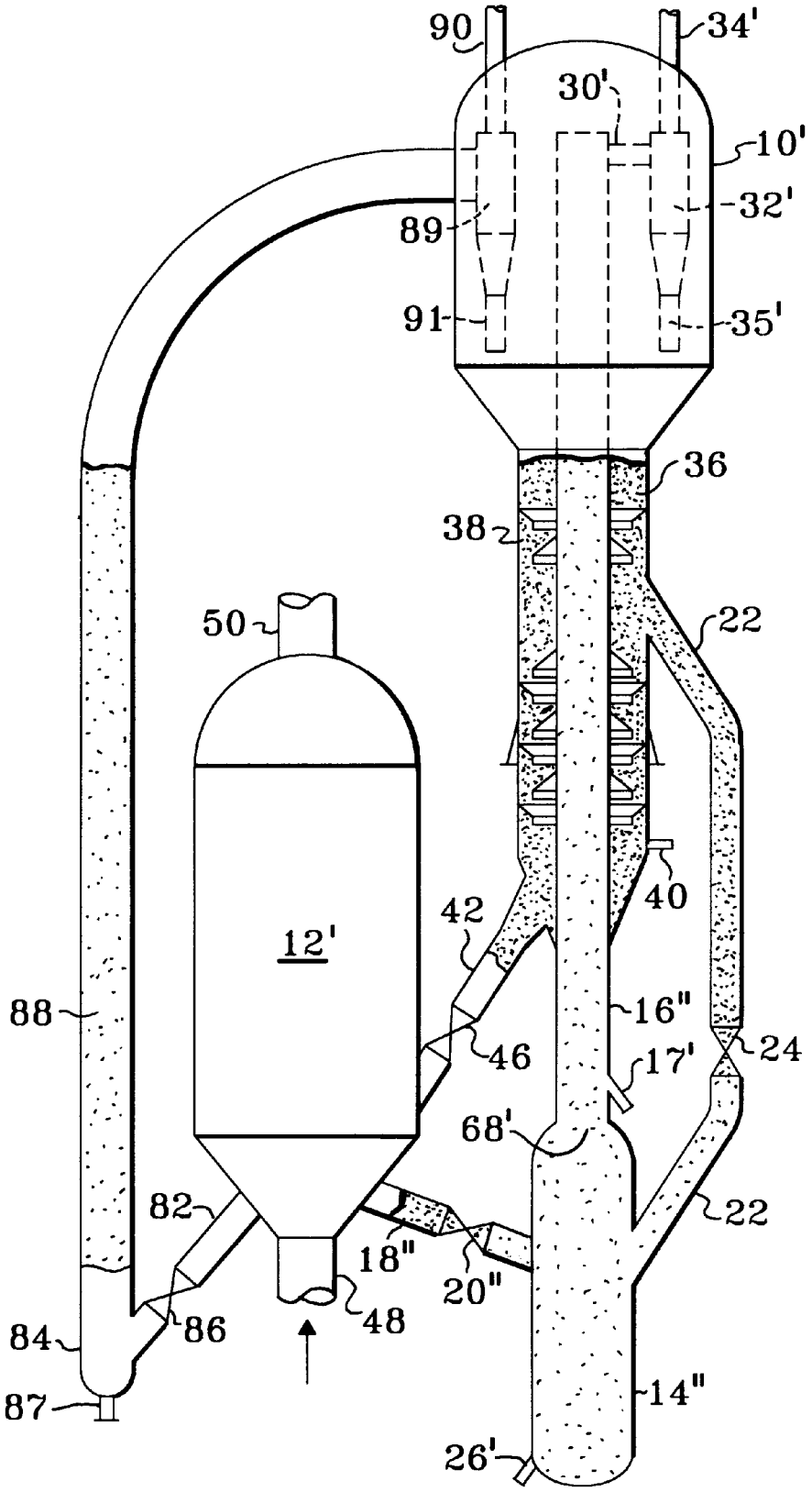
FIG. 3 is an alternate sectional elevation showing an FCC unit arranged to use parallel flow contacting conduits in the process of this invention.

FIG. 3 shows yet another arrangement for an FCC unit wherein the feed to the principally thermal cracking conduit passes through a separate reaction conduit and a principally thermally cracked stream passes directly to a cyclone separator for its separate recovery. The arrangement of FIG. 3 is similar to the arrangement of FIGS. 1 and 2. Unless otherwise mentioned, equipment and components depicted in FIG. 3 will operate in the same manner as similar equipment depicted in FIGS. 1 and 2.

FIG. 3 shows regenerated catalyst flowing from a regenerator 12' through an additional regenerated conduit 82 into a "Y" section 84 at a rate regulated by a control valve 86. A feed for thermal cracking enters the bottom of Y section 84 through a nozzle 87. Rapid vaporization of the feed fluidizes the catalyst and transports it up a reaction conduit 88 to preferentially effect a thermal cracking of the entering feed. Alternately, the feed for thermal cracking may directly enter reaction conduit 88 downstream of Y section 84.

FIG. 3 shows an optional arrangement wherein the downstream end of reaction conduit 88 discharges the mixture of catalyst and thermally cracked hydrocarbons directly into a cyclone separator 89 and an outlet 90 independently withdraws thermally cracked products from reactor 10' for direct recovery or further separation and blending. The dip-leg conduit 91 returns the contacted catalyst from the thermal cracking reaction to dense bed 36 of stripping section 38. Alternately, the downstream end of reaction conduit 88 may be arranged to blend the product from both risers as previously described.

Contacted catalyst from dip leg 91 together with carbonized catalyst from a dip leg conduit 35' return to blending vessel 14". Blending vessel 14" differs from blending vessel 14' of FIG. 2 by the direct passage of catalyst from regenerator 12' through a regenerator conduit 18" into blending vessel 14" at a rate regulated by a control valve 20". Blending vessel 14" mixes the contacting catalyst with any added regenerated catalyst to provide a blended mixture to the inlet 68' of the riser section 16". To promote mixing, an additional mixing or fluidizing gas may enter the bottom of blending vessel 14" through a nozzle 26'. Feed for principally catalytic cracking enters riser section 16" through a nozzle 17'. A mixture of catalyst and the principally catalytically cracked hydrocarbons leaves riser section 16" through an outlet 30'. Cyclone 32' separates hydrocarbon vapors from the carbonized catalyst. The separated catalyst exits cyclone 32' through dip leg 35'. The catalytically cracked effluent passes from outlet 34' to appropriate fluid separation facilities for the recovery of products and recycle streams.

EXAMPLE

This example simulates the cracking of a light naphtha stream in a riser that operates in accordance with this invention. The following example shows that an upstream riser reaction zone that operates with regenerated catalyst can effect significant naphtha cracking to more valuable products, particularly propylene. In this example, the light naphtha product produced from cracking the heavy FCC feed passes back to the high severity, first cracking zone. The regenerated catalyst at a temperature of 1360° F. and a catalyst to naphtha ratio of 50/1 contacts the recycle naphtha stream which has the composition shown in Table 1. Contact with the catalyst for approximately 2 seconds at a temperature of 1285° F. produces a cracked product having the composition shown in Table 2.

Contacted catalyst from the naphtha cracking zone and equilibrium catalyst from the heavier feed cracking zone containing an average of 0.4 wt % and 0.90 wt % coke respectively are then used to contact the heavier feed in the second contact zone. The composition of the heavier feed is also shown in Table 1. Conversion of the heavier feed occurs at 1040° F. using a low H-transfer US-Y type octane catalyst, at a catalyst to oil ratio of 12/1. The product yields from cracking the heavier feed are also shown in Table 2 as is the final product yield resulting from the first cracking of the heavy feed combined with the results of the once through cracking of the light naphtha recycle.

Without the use of recycled carbonized catalyst back to the mixing chamber, the spent equilibrium catalyst coke content is 0.55 wt % rather than 0.90 wt %; the regenerated catalyst temperature is 1275° F.; and the lower riser cracking zone temperature with an equivalent amount of naphtha recycle is 1200° F., a temperature insufficient to convert a significant amount of naphtha to cracked products.

TABLE 1

| Feed Stock Definition | | |
|---|---|---|
| | Light Naphtha Recycle | FCC VGO |
| IBP ° F. | 100 | 540 |
| EBP ° F. | 250 | 1110 |
| ° API | 68 | 23 |
| UOP K | 12.4 | 11.9 |
| S wt % | 0.01 | 0.34 |
| Con Carbon wt % | — | 0.29 |
| P/O/N/A | 42/42/8/8 | — |

TABLE 2

| Cracked Product Yields | | | |
|---|---|---|---|
| | VGO Feed | Light Naphtha Recycle | Combined |
| Products - wt % | | | |
| $H_2S$ | 0.1 | — | 0.1 |
| $H_2$ | 0.07 | 0.03 | 0.08 |
| $C_1$ | 2.2 | 1.9 | 2.8 |
| $C_2$= | 1.6 | 4.1 | 2.9 |
| $C_2$ | 1.8 | 1.0 | 2.1 |
| $C_3$= | 6.1 | 16.9 | 11.5 |
| $C_3$ | 2.3 | 4.1 | 3.6 |
| $C_4$= | 8.8 | 1.9 | 9.4 |
| $iC_4$ | 3.4 | 4.4 | 4.8 |
| $nC_4$ | 1.3 | 1.9 | 1.9 |
| $C_5$+ Gasoline | 52.5 | 54.9 | 38.3 |
| LCO + CO | 14.0 | 3.2 | 15.0 |
| Coke | 5.8 | 5.7 | 7.5 |

Table 2 demonstrates that the use of recycled spent catalyst back to a mixing zone generates a sufficient increase in regenerated catalyst temperature such that a naphtha stream can be cracked in a first cracking zone to produce high yields of valuable light hydrocarbon products, followed by cracking of a heavier FCC feed in a second cracking zone.

What is claimed is:

1. A fluidized catalytic cracking process for the principally thermal cracking of a secondary feed comprising naphtha having components in a boiling range of from 350–430° F. and the principally catalytic cracking of a primary feed comprising a vacuum gas oil containing hydrocarbons in a boiling range of from 600–1100° F. in an arrangement of separate reaction conduits, the process comprising:

a) passing the secondary feed and regenerated catalyst particles to an upstream portion of a thermal contacting conduit and transporting the regenerated catalyst and secondary feedstock through the thermal contacting conduit to convert the feed to a thermal fluid and producing a first quantity of contacted catalyst particles by the deposition of coke on the regenerated catalyst particles;

b) discharging contacted catalyst particles and the thermal fluid from a discharge end of the thermal contacting conduit;

c) passing the contacted catalyst particles to a blending vessel and blending a carbonized catalyst with the contacted catalyst to produce a blended catalyst stream in substantial thermal equilibrium;

d) passing the blended catalyst stream from the blending vessel into a catalytic contacting conduit and contacting the blended catalyst mixture in the catalytic contacting conduit with the primary feed to produce a mixture of catalyst and catalytic fluid;

e) separating catalyst from the mixture in a primary catalyst separation zone and recovering a primary effluent stream from the primary catalyst separation zone;

f) recovering spent catalyst having a minimum coke content of 0.7 wt % for regeneration in a regeneration zone; and, g) passing the primary effluent and, optionally, a separately recovered portion of the thermal fluid to a fluid separation zone and recovering an olefin product stream comprising ethylene and/or propylene and a primary product stream.

2. The process of claim 1 wherein the spent catalyst for regeneration has a coke content of at least 0.8 wt %.

3. The process of claim 1 wherein the regenerated catalyst has a temperature of at least 1300° F.

4. The process of claim 1 wherein the thermal contacting conduit discharges the contacted catalyst and the thermal fluid from the discharge end directly into the blending vessel.

5. The process of claim 1 wherein the mixture of regenerated catalyst and secondary feed pass through the thermal contacting conduit at a catalyst to oil weight ratio of from 12/1 to 150/1.

6. The process of claim 1 wherein the secondary feed has a residence time of from 0.5 to 5.0 seconds in the thermal contacting conduit.

7. A process for the fluidized catalytic cracking (FCC) of a light feedstock comprising naphtha, having components in a boiling range of from 350–430° F. and a heavy feedstock containing hydrocarbons boiling in a range of from 600–1100° F. in a series flow conduit arrangement, the process comprising:

a) passing the light feedstock and regenerated catalyst particles to an upstream portion of a secondary contacting conduit and transporting the regenerated catalyst and light feedstock through the secondary contacting conduit to convert the light feedstock to a principally thermal cracked fluid and producing contacted catalyst particles by the deposition of coke on the regenerated catalyst particles;

b) discharging the first quantity of contacted catalyst particles and the principally thermal cracked fluid from a discharge end of the secondary contacting conduit into a blending vessel and blending carbonized catalyst with the contacted catalyst to produce a blended catalyst stream in substantial thermal equilibrium;

c) passing the blended catalyst stream from the blending vessel into a primary contacting conduit and contacting the blended catalyst mixture in the primary contacting conduit with the heavy feedstock having a higher average boiling point than the light feedstock to produce a mixture of catalyst and a principally catalytically cracked fluid;

d) separating catalyst from the mixture in a primary catalyst separation zone and recovering from the primary catalyst separation zone a primary effluent stream and spent catalyst having a minimum coke content of 0.7 wt %; and e) passing the primary effluent stream and, optionally, a separately recovered portion of the principally thermal cracked fluid to a fluid separation zone and recovering a light product stream comprising ethylene and propylene and a heavy product stream.

8. The process of claim 7 wherein the mixture of regenerated catalyst and secondary feed in the secondary contacting conduit has an average temperature of from 1225 to 1350° F.

9. The process of claim 7 wherein the primary and secondary contacting conduits comprise risers and catalyst and fluids pass upwardly through the risers.

10. The process of claim 7 wherein the principally thermal cracked fluid comprises propylene and ethylene in a concentration of 10–25 wt % of the principally thermal cracked fluid.

11. A fluidized catalytic cracking process for the principally thermal cracking of a secondary feed and the principally catalytic cracking of a primary feed in an arrangement of separate reaction conduits, the process comprising:

a) passing the secondary feed and regenerated catalyst particles to an upstream portion of a thermal contacting conduit and transporting the regenerated catalyst and secondary feed through the thermal contacting conduit to convert the feed to a thermal fluid and producing a first quantity of contacted catalyst particles by the deposition of coke on the regenerated catalyst particles;

b) discharging contacted catalyst particles and the thermal fluid from a discharge end of the thermal contacting conduit;

c) passing the contacted catalyst particles and a carbonized catalyst to a blending vessel through a single inlet and blending the carbonized catalyst with the contacted catalyst to produce a blended catalyst stream;

d) passing the blended catalyst stream from the blending vessel into a catalytic contacting conduit and contacting the blended catalyst mixture in the catalytic contacting conduit with the primary feed to produce a mixture of catalyst and catalytic fluid;

e) separating catalyst from the mixture in a primary catalyst separation zone and recovering a primary effluent stream from the primary catalyst separation zone;

f) recovering spent catalyst for regeneration in a regeneration zone; and, g) passing the primary effluent and, optionally, a separately recovered portion of the thermal fluid to a fluid separation zone and recovering an olefin product stream comprising ethylene and/or propylene and a primary product stream.

12. The process of claim 11 wherein the thermal fluid enters the primary catalyst separation zone and then mixes with the catalytic fluid.

13. The process of claim 11 wherein regenerated catalyst passes directly into the blending vessel.

14. A process for the fluidized catalytic cracking (FCC) of a light feedstock and, with respect to the light feedstock, a relatively heavier feedstock in a series flow conduit arrangement, the process comprising:

a) passing the light feedstock and regenerated catalyst particles to an upstream portion of a secondary contacting conduit and transporting the regenerated catalyst and light feedstock through the secondary contacting conduit to convert the light feedstock to a principally thermal cracked fluid and producing contacted catalyst particles by the deposition of coke on the regenerated catalyst particles;

b) discharging the first quantity of contacted catalyst particles and the principally thermal cracked fluid from a discharge end of the secondary contacting conduit into a blending vessel and blending carbonized catalyst with the contacted catalyst to produce a blended catalyst stream;

c) separating at least a portion of the principally thermal cracked fluid from the contacted catalyst particles and recovering at least a portion of the thermal cracked fluid from the blending vessel;

d) passing the blended catalyst stream from the blending vessel into a primary contacting conduit and contacting the blended catalyst mixture in the primary contacting conduit with the relatively heavier feedstock having a higher average boiling point than the light feedstock to produce a mixture of catalyst and a principally catalytically cracked fluid;

e) separating catalyst from the mixture in a primary catalyst separation zone and recovering a primary effluent stream from the primary catalyst separation zone; and, f) passing the primary effluent stream and, optionally, a separately recovered portion of the principally thermal cracked fluid to a fluid separation zone and recovering a light product stream comprising ethylene and propylene and a heavy product stream.

15. The process of claim 14 wherein the fluid separation zone includes at least two fractionation sections and the principally thermal cracked fluid and the primary effluent pass to separate fractionation sections.

* * * * *